US006539277B1

(12) United States Patent
Alvis

(10) Patent No.: US 6,539,277 B1
(45) Date of Patent: Mar. 25, 2003

(54) LAPPING SURFACE PATTERNING SYSTEM

(75) Inventor: Derek J. Alvis, San Jose, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 436 days.

(21) Appl. No.: 09/619,045

(22) Filed: Jul. 19, 2000

(51) Int. Cl.[7] ..... G06F 19/00; B23C 1/18; B24B 53/00

(52) U.S. Cl. ..... 700/191; 700/160; 409/80; 451/5; 451/72; 451/443

(58) Field of Search ..... 700/61, 160, 182, 700/183, 190–194; 451/56, 324, 443–444, 5, 72, 527; 409/80, 200

(56) References Cited

U.S. PATENT DOCUMENTS

| | | | | | |
|---|---|---|---|---|---|
| 3,986,433 A | | 10/1976 | Walsh et al. | 90/15 A |
| 4,380,412 A | | 4/1983 | Walsh | 409/314 |
| 4,996,798 A | | 3/1991 | Moore | 51/161 |
| 5,779,526 A | * | 7/1998 | Gill | 451/324 |
| 5,941,762 A | * | 8/1999 | Ravkin et al. | 451/156 |
| 6,306,008 B1 | * | 10/2001 | Moore | 451/5 |
| 6,340,325 B1 | * | 1/2002 | Chen et al. | 451/56 |

OTHER PUBLICATIONS

Parker Automation "Redless Actuators" (1997).
Parker Automation "The 6K Controller".
Parker Automation "A Full Spectrum Of Motion & Positioning Products".

* cited by examiner

*Primary Examiner*—Leo Picard
*Assistant Examiner*—Elliot Frank

(57) ABSTRACT

A lapping surface patterning system includes a patterning apparatus which can be removably mounted over the lapping surface of a continuous polishing tool. The patterning apparatus includes a radial arm having a movable cutting tool carriage mounted thereon. The cutting tool carriage positions a cutting tool at a desired radius from the center of the lapping surface. The patterning apparatus further includes an outer support having a carriage which positions an outer end of the radial arm, thereby positioning the cutting tool at a desired angular position. A motion control system transmits control signals to the two carriages, thereby driving the cutting tool over a desired pattern. This system can be used to repeatedly and consistently form a pattern of grooves in the lapping surface of the polishing tool.

15 Claims, 4 Drawing Sheets

LAPPING SURFACE PATTERNING SYSTEM

BACKGROUND

1. Field of the Invention

This invention relates to a system for patterning a lapping surface of a polishing tool.

2. Description of Related Art

Continuous polishing ("CP") machines have been used to polish workpieces to provide the workpieces with extremely flat surfaces. A typical CP machine may have an annular lapping table with an inner diameter of approximately 16 inches and an outer diameter of approximately 50 to 60 inches. For the polishing of optical substrates formed of, for example, borosilicate crown optical glass or fused silica, pitch is melted and poured onto the surface of the lapping table. The pitch is a viscous tar-like substance that serves as a carrier for a polishing agent, such as zirconia or cerium oxide. When coated onto the lapping table, the pitch forms a hard lapping surface for polishing the face of the workpiece. Various forms of coating substances are well-known to those of ordinary skill in the art, and one exemplary pitch is Gugolz #73 or #82. The Gugolz pitch can be melted and then poured over the lapping table as the table is rotated to form an even lapping surface. After cooling, the pitch solidifies to form a hard lapping surface.

A slurry, such as a distilled water and cerium oxide compound, is deposited onto the lapping surface during polishing. Each workpiece is captured in position by a septum, and a downforce can be applied on the backside of the workpiece to press the front face against the rotating lapping surface. The septum is held within a rotating ring, enabling the workpieces to rotate within the ring over the lapping surface.

In order to facilitate good slurry distribution and to prevent hydroplaning of the workpiece, grooves may be cut into the hard lapping surface. One method for providing these grooves is to draw a single point tool or a rotating drill bit along the lapping surface in a radial direction and/or rotate the lapping surface. However, the lapping tool may not provide precise control over the rotation of the platen and the movement of the cutting tool may generally be controlled in the radial direction alone. This method can be used to produce grooves in circular, spiral, or radial patterns on the lapping surface, but other types of patterns are difficult or impossible to produce. In addition, the polishing of substrates using a lapping surface patterned with such groove patterns may produce poor results.

In another method for patterning the lapping surface, an operator will manually pull a band saw blade across the lapping surface to create a first set of parallel grooves in the lapping surface. Then, the operator cuts another set of parallel grooves at some angle to the first set to create a cross-hatch groove pattern on the lapping surface. There are numerous problems associated with this method. First, the manual cutting of the grooves does not provide consistent results and depends heavily on the skill and performance of the operator. The angle the blade is held, the pressure applied, and the precision of the groove placement all affect the final pattern. In addition, the process is not ergonomically safe because for large lapping surfaces, the operator must reach outward from the waist level at distances of over 30 inches while engaging in repetitive motion. Another disadvantage of this process is that the cutting is time consuming, resulting in significant tool down times when the lapping surface must be re-patterned. Yet another disadvantage is that the drawing of a blade across the lapping surface produces flakes of pitch material, which creates sticky dust particles. These particles are time consuming to clean and may pose a health hazard if inhaled by the operator.

Accordingly, there is a need for an improved lapping surface patterning system which efficiently produces consistent patterns on the lapping surface.

SUMMARY

In accordance with the invention, a system is provided for patterning a lapping surface on a lapping tool, said lapping surface having a circular inner diameter and a circular outer diameter. The system comprises: an outer support mounted on the lapping tool; a radial arm having an inner end rotatably supported at an axis of rotation located within the inner diameter of the lapping surface and an outer end movably supported by said outer support such that said radial arm is rotatable about the axis of rotation; a cutting tool mounted on the radial arm for movement from the inner diameter of the lapping surface to the outer diameter of the lapping surface; a radial positioning motor for positioning the cutting tool at a plurality of locations between the inner diameter of the lapping surface and the outer diameter of the lapping surface; and an angular positioning motor for rotating the radial arm about the axis of rotation to position the radial arm at a plurality of angular locations.

In accordance with another aspect of the present invention, a system is provided for patterning a lapping surface on a lapping tool, said lapping surface having a circular inner diameter and a circular outer diameter. The system comprises a patterning apparatus and a motion controller. The patterning apparatus comprises: an outer support mounted on the lapping tool; a radial arm having an inner end rotatably supported at an axis of rotation located within the inner diameter of the lapping surface and an outer end movably supported by said outer support such that said radial arm is rotatable about the axis of rotation; an angular positioning motor for rotating the radial arm about the axis of rotation to position the radial arm at a plurality of angular locations; a cutting tool mounted on the radial arm for movement from the inner diameter of the lapping surface to the outer diameter of the lapping surface; and a radial positioning motor for positioning the cutting tool at a plurality of locations between the inner diameter of the lapping surface and the outer diameter of the lapping surface. The motion controller comprises: a position memory for storing radial position information and angular position information; and a motor interface connecting the position memory with the radial positioning motor and the angular positioning motor to transmit the radial position information to the radial positioning motor and the angular position information to the angular positioning motor.

In accordance with another aspect of the present invention, a method is provided for patterning a lapping surface on a lapping tool, said lapping surface having a circular inner diameter and a circular outer diameter. The method comprises: positioning a patterning apparatus over the lapping surface, said patterning apparatus comprising an outer support mounted on the lapping tool, a radial arm having an inner end rotatably supported at an axis of rotation located within the inner diameter of the lapping surface and an outer end movably supported by said outer support, and a cutting tool mounted on the radial arm for movement from the inner diameter of the lapping surface to the outer diameter of the lapping surface; storing pattern information in a motion controller memory; transmitting control information to a radial positioning motor for positioning the cutting tool along the radial arm and to an angular positioning motor for rotating the radial arm about the axis of rotation, said control information corresponding to said pattern information in the motion controller memory; and operating said cutting tool to form grooves in the lapping surface corresponding to the pattern information.

BRIEF DESCRIPTION OF THE DRAWINGS

Use of the same reference symbols in different figures indicates similar or identical items.

DETAILED DESCRIPTION OF THE PREFERRED EMBODIMENTS

Figure 1:
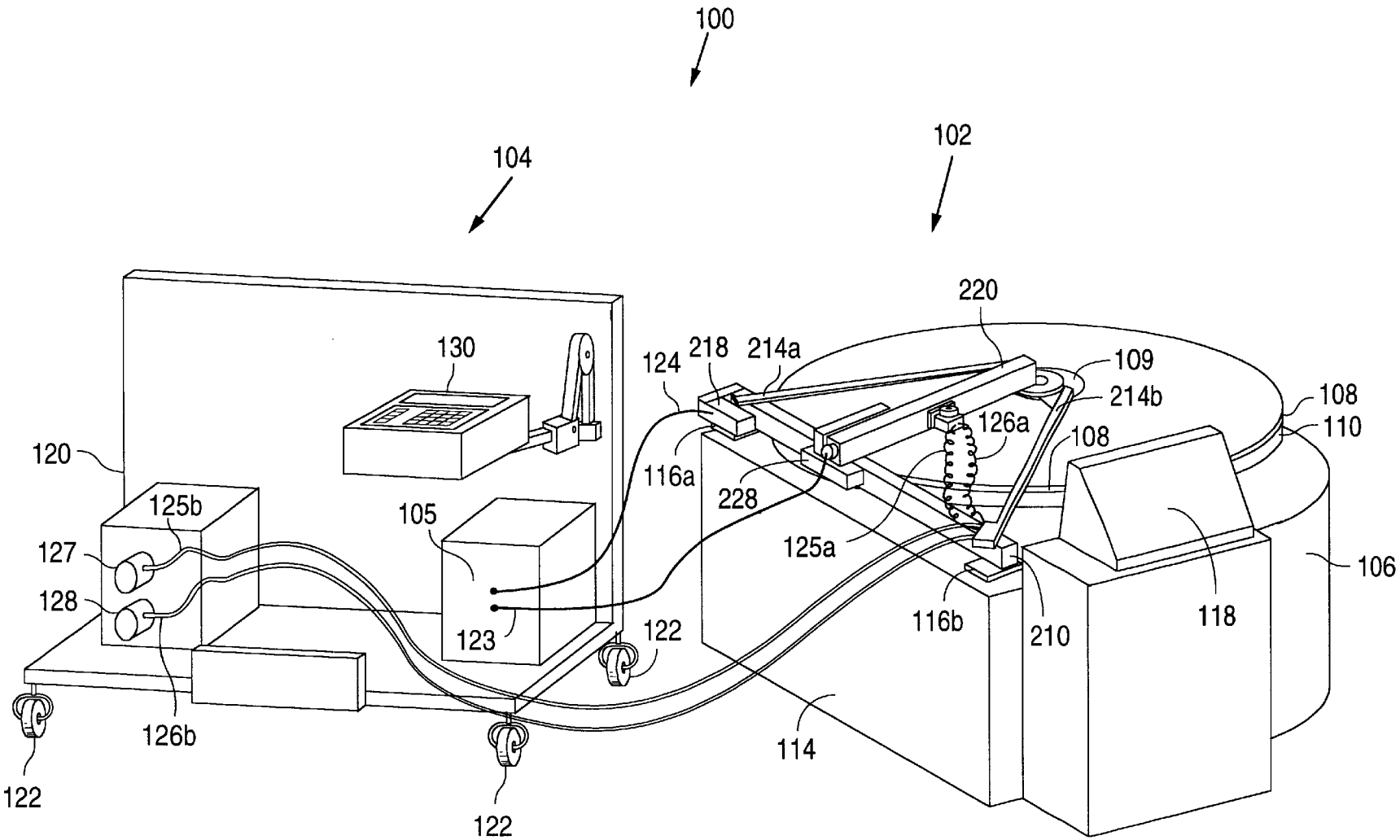
FIG. 1 shows a perspective view of a lapping surface patterning system in accordance with an embodiment of the present invention.

FIG. 1 shows an exemplary lapping surface patterning system 100 for use with a continuous polishing ("CP") tool 106, which can be, for example, a Strasbaugh 6CG polishing tool. CP tool 106 includes a lapping table 110 having an upper surface forming an annular lapping surface 108. A center region 109 defines the inner diameter of lapping surface 108 and the outer edge of lapping table 110 defines an outer diameter of lapping surface 108. Lapping table 110 is rotated by a motor contained within body 114 of CP tool 106. Control system 118 provides an interface and processing mechanism for operating CP tool 106.

Patterning system 100 includes a patterning apparatus 102 and a control system 104, which is connected to patterning apparatus 102 via control/power lines 123, 124, rinse water tube 125, and compressed air tube 126. Control system 104 may be mounted onto a portable rack 120 having wheels 122. When patterning system 100 is not in use, patterning apparatus 102 can be loaded onto rack 120, and the entire patterning system 100 can be easily moved and stored elsewhere, thereby freeing up floorspace adjacent CP tool 106. Control system 104 includes a motion controller 105 and a user interface 130 for controlling operation of patterning apparatus 102. In addition, control system 104 includes a compressed air source 128 for providing compressed air through compressed air tube 126*b*, and a rinse water source 127 for providing rinse water through rinse water tube 125*b*. Control system 104 also includes interfaces (not shown) for connecting compressed air source 128 and rinse water source 127 to external compressed air and rinse water supplies.

When in use, the outer two corners of patterning apparatus 102 are mounted onto outer supports 116*a*–116*b* on CP tool 106 beyond the edge of lapping table 110. Patterning apparatus 102 also includes a center portion 202 which is mounted on a center support (not shown) at center region 109 of lapping table 110. By providing fixed reference points for patterning apparatus 102, these supports can enable patterning apparatus 102 to be repeatedly removed and precisely re-mounted onto CP tool 106.

Figure 2:
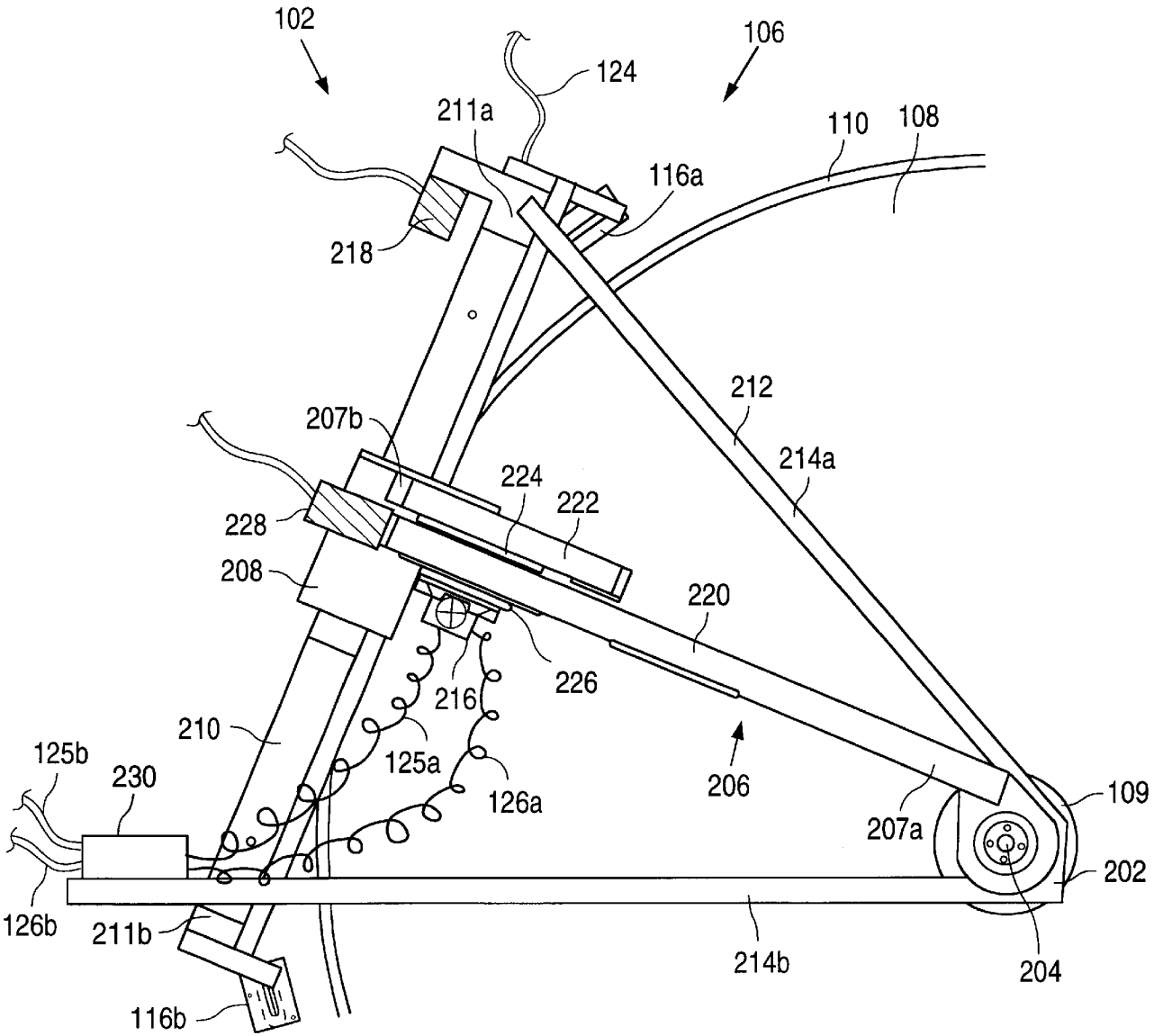
FIG. 2 shows a top view of a patterning apparatus mounted over a lapping surface in accordance with an embodiment of the present invention.

In accordance with a first embodiment of the present invention, FIG. 2 is a top view of patterning apparatus 102 mounted onto CP tool 106. A radial arm 206 has an inner end 207*a* rotatably supported by center portion 202 for rotation about axis of rotation 204 and an outer end 207*b* supported by carriage 208. Carriage 208 is mounted for linear movement along an outer support 210. The ends 211*a*, 211*b* of outer support 210 are connected to a frame 212 and are supported by outer supports 116*a*, 116*b*. As shown in FIG. 2, outer supports 116*a*, 116*b* include slots which allow the positioning of ends 211*a*, 211*b* of outer support 210 to be adjusted. When the rotation of lapping table 110 cannot be precisely controlled, this adjustability enables patterning apparatus 102 to be precisely positioned relative to the rotational position of lapping table 110.

Frame 212 provides structural rigidity to patterning apparatus 102 and includes side beams 214*a*, 214*b*. In alternative embodiments, radial arm 206 and outer support 210 provide sufficient structural support for patterning apparatus 102, so side beams 214*a*, 214*b* are not used.

Outer support 210 and carriage 208 may be provided by, for example, a screw drive rodless linear actuator manufactured by the Parker Hannifin Corporation of Wadsworth, Ohio. Suitable linear actuators are described in the "ER Series Stepper and Servo Driven Rodless Actuators," Catalog 1893/USA, from the Parker Hannifin Corporation, incorporated by reference herein. In this embodiment, carriage 208 is supported by an internally mounted square rail bearing inside of outer support 210. A stepper motor 218 is connected to a ball screw provided inside outer support 210 to move carriage 208 along the length of outer support 210.

Radial arm 206 includes a rail portion 220 connected via a coupling 224 to a free travel slide portion 222. The center axis of rail portion 220 is parallel to the center axis of free travel slide portion 222. Free travel slide portion 222 includes outer end 207*b*, which is attached to carriage 208 on outer support 210. When radial arm 206 is at the position shown in FIG. 2, the length of radial arm 206 is at a minimum. As carriage 208 moves towards end 211*a* or end 211*b* of outer support 210, the distance between inner end 207a and outer end 207*b* increases. To accommodate this increase in distance, free travel slide portion 222 enables rail portion 220 to slide relative to free travel slide portion 222 in the direction of their center axes, thereby enabling the overall length of radial arm 206 to adjust, depending on the location of carriage 208 along outer support 210.

A cutting tool 216 is mounted onto a cutting tool carriage 226 for movement along radial arm 206. Rail portion 220 and cutting tool carriage 226 are provided by a linear ball screw stage, similar to that used for outer support 210 and carriage 208. A motor 228 is provided at outer end 207*b* to drive the linear movement of cutting tool carriage 226.

Figure 3:
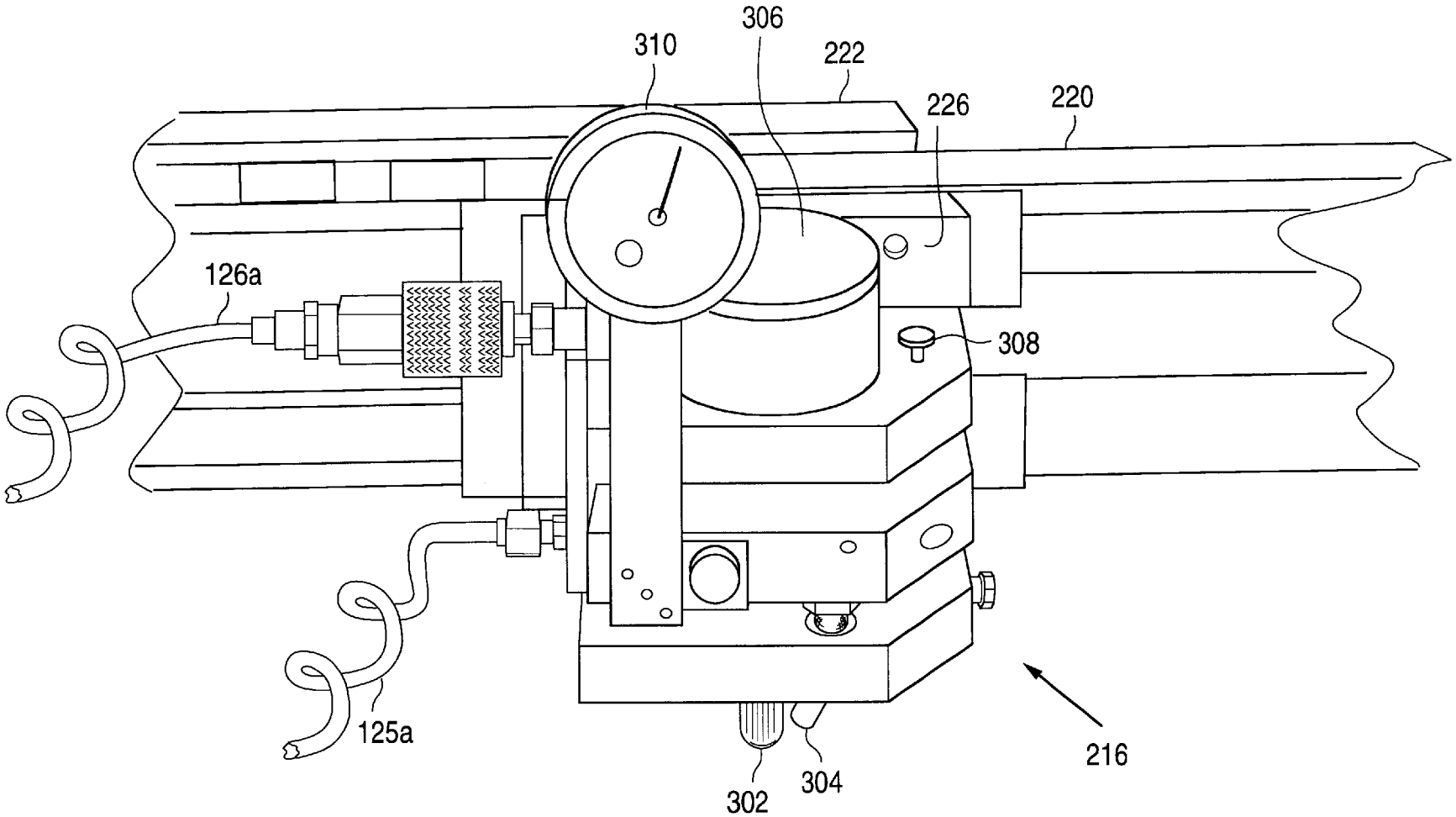
FIG. 3 shows an enlarged view of a cutting tool in accordance with an embodiment of the present invention.

FIG. 3 shows an enlarged view of cutting tool 216. Cutting tool 216 includes a carbide burr cutting tip 302 and a pneumatic high-speed spindle 306, such as, for example, a model 230JS air spindle from Air Turbine Technology, Inc., of Boca Raton, Fla. The spindle 306 can be used to form large grooves in lapping surface 108. Adjustment knob 308 may be used to set the vertical position of cutting tip 302, and a travel indicator 310 may be used to monitor the cutting depth. Compressed air tube 126*a* provides compressed air from compressed air source 128 (FIG. 1) to spindle 306 to drive rotation of the cutting tip 302. Rinse water tube 125*a* provides rinse water from rinse water source 127 (FIG. 1) to nozzle 304 adjacent to cutting tip 302 to flood the region of lapping surface 108 around cutting tip 302. Rinse water tube 125*a* and compressed air tube 126*a* are connected to manifold 230, which, in turn, is connected to rinse water tube 125*b* and compressed air tube 126*b*. The use of coiled tubes 125*a*, 126*a* and manifold 230 helps to prevent rinse water tube 125*a* and compressed air tube 126*a* from becoming tangled as cutting tool 216 traces out the desired lapping surface pattern.

The operation of this embodiment of the invention is as follows. As described above, lapping surface 108 can be used to polish glass surfaces to a high degree of flatness. A large, flat, rotating conditioner is pressed against lapping surface 108 to maintain the flatness of lapping surface 108 during use. During use, lapping surface 108 will wear and flow, thereby wearing away the patterned grooves on lapping surface 108. The speed of deterioration may vary from days to weeks or longer, depending on the amount of the use, the pitch used, and the workpiece being polished. Periodically, a new set of patterned grooves in lapping surface 108 must be formed to replace the grooves which had been worn away. In addition, as lapping surface 108 is worn and re-patterned, the thickness of the pitch forming lapping surface 108 will decrease. Before the pitch is completely worn through to lapping table 110, a new layer of pitch is applied to lapping surface 108.

Thus, the pattern on lapping surface 108 must be re-formed periodically after the grooves are worn down from use and after fresh layers of pitch are applied. At these times, portable rack 120 holding patterning apparatus 102 is brought to the location of CP tool 106. Patterning apparatus 102 is then mounted onto CP tool 106, as shown in FIG. 2. Outer supports 116*a*–116*b* and center support (covered by center portion 202 in FIG. 2) are used to precisely position patterning apparatus 102 over lapping surface 108. In many cases, there are various mechanisms or other intrusive structures in the area immediately surrounding lapping surface 108 on CP tool 106. These structures include, for example, the conditioner, the septums used to hold the workpieces, pulleys for guiding the septums, splash guards, and overhanging bracing.

Figure 4B:
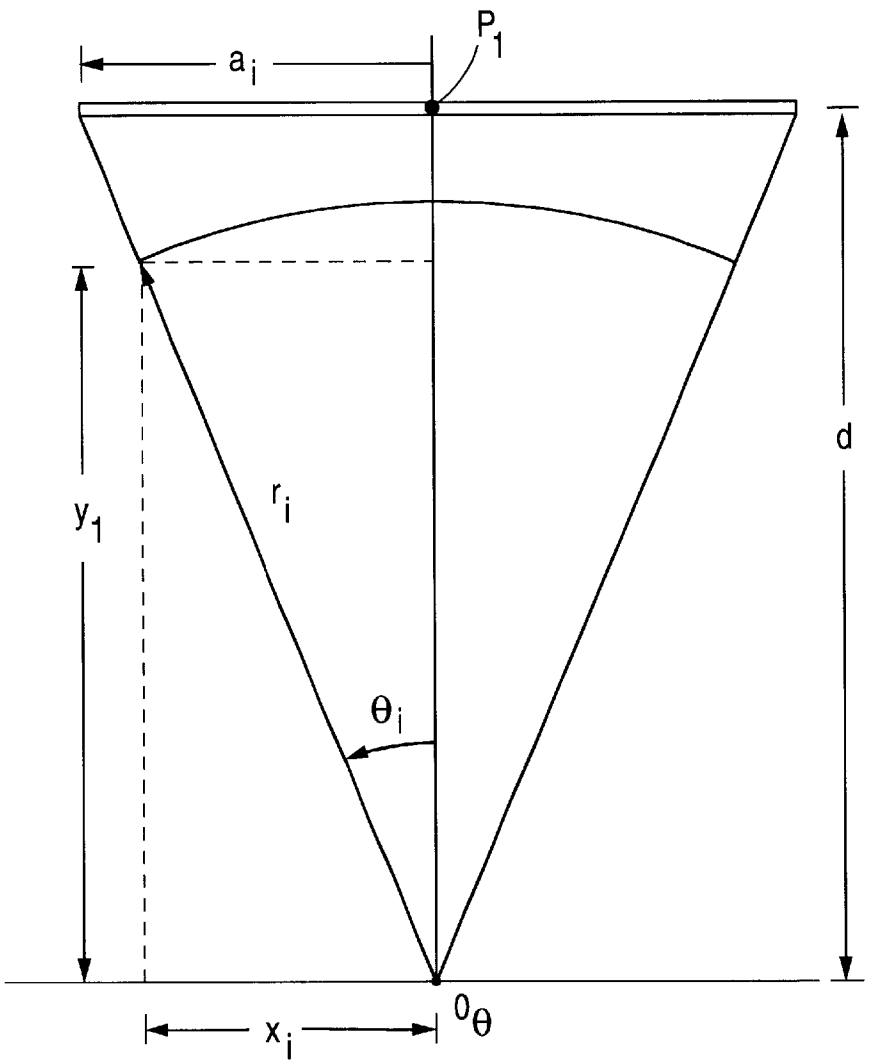
FIGS. 4*a*–4*b* illustrate the conversion of a lapping surface pattern from Cartesian coordinates to polar coordinates in accordance with an embodiment of the present invention.
Figure 4A:
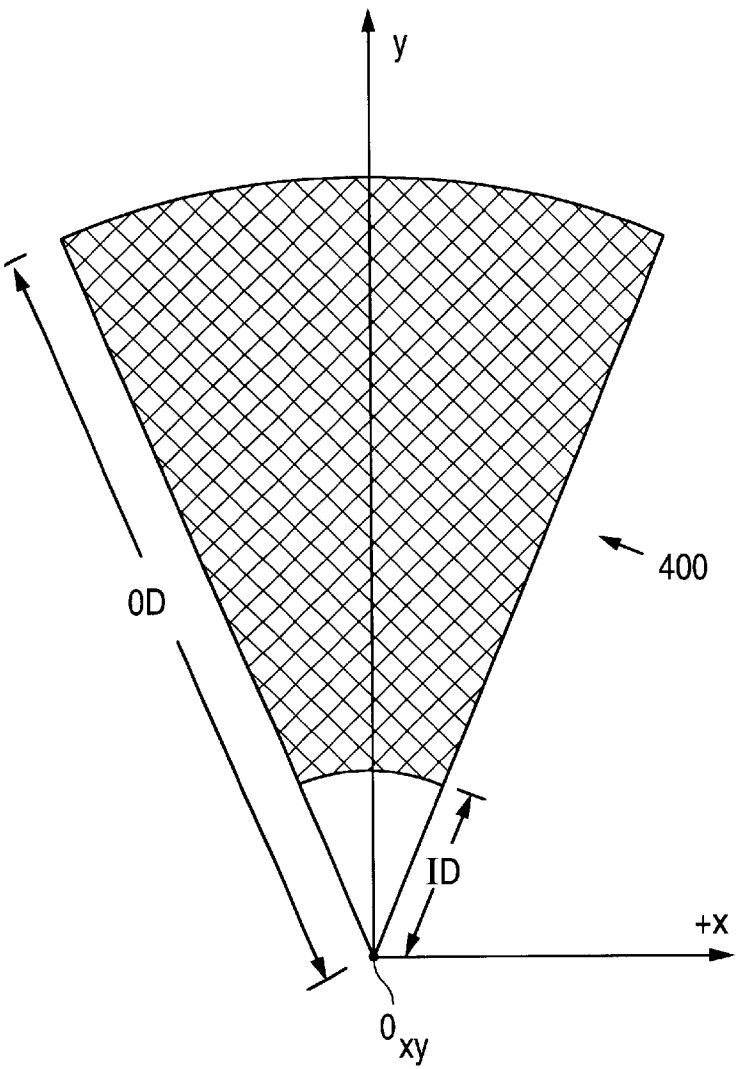

A two-dimensional pattern for lapping surface 108 is prepared using, for example, a computer-aided design (CAD) program, and the CAD program can be used to generate a map of the desired pattern 400 using x-y coordinates having an origin at $O_{xy}$, as shown in FIG. 4*a*. The x-y coordinate map is then converted using standard trigonometric calculations to obtain a map of the desired pattern using a polar (r-θ) coordinate system having an origin at $O_\theta$, as shown in FIG. 4*b*. The coordinate conversion may be performed as follows:

$$r_i = \sqrt{x_i^2 + y_i^2}$$

$$\theta_i = \tan^{-1}\left(\frac{-x_i}{y_i}\right)$$

$$a_i = d \times \tan\theta_i = d \times \left(\frac{-x_i}{y_i}\right)$$

where $r_i$ is the position of cutting tool carriage 226 along radial arm 206, d is the distance from axis of rotation 204 to centerpoint $P_1$ on outer support 210, and $a_i$ is the position of angular arm carriage 208 along outer support 210, relative to $P_1$. In the embodiment shown in FIG. 2, which is used for a lapping surface having an outer diameter ranging from 50 to 60 inches, d is 34.8 inches.

The r-θ polar coordinate map is then loaded into motion controller 105. Motion controller 105 may be, for example, a 6K Controller from the Parker Hannifin Corporation. This motion controller 105 is provided with an interface which enables a connection between motion controller 105 and a personal computer using the Windows® operating system from the Microsoft Corporation of Redmond, Wash., together with the Parker Hannifin Motion Planner™ software. The 6K Controller and Motion Planner™ software are described in "6K Controller: Universal Motion Controller," Catalog 8180/USA, incorporated herein by reference in its entirety. The Motion Planner™ software receives the r-θ polar coordinate map in text format, and reformats the coordinate map to be received by motion controller 105. The Motion Planner™ software can also be used to edit the pattern and provide other communication to motion controller 105. Motion controller 105 receives the reformatted r-θ coordinate map and stores the map in memory.

When lapping surface patterning system 100 is in use, motion controller 105 transmits control signals along control/power lines 123, 124 to radial arm 206 and outer support 210. These control signals drive motors 218 and 228 to position angular arm carriage 208 and cutting tool carriage 226, thereby directing cutting tool 216 along the desired pattern. User interface 130 allows a user to operate motion controller 105 to manually move carriages 222 and 208, set parameters such as feed rate, and select and operate pattern programs. Rinse water source 127 and compressed air source 128 can be manually operated, or can be controlled automatically by motion controller 105.

As the rotating bit 302 in cutting tool 216 is positioned by carriages 208 and 226, cutting tool 216 creates grooves in lapping surface 108 in the desired pattern. The depth of the grooves can be adjusted by raising or lowering cutting tool 216 using adjustment knob 308. The shape of the grooves can be adjusted by using different cutting bits. Rinse tube 125 may provide a rinsing fluid, such as distilled water, to the location of cutting tool 216 via nozzle 304. This rinsing action can serve to cool the cutting bit 302 on cutting tool 216, rinse away pitch particles produced during the patterning process, and cool lapping surface 108 to prevent the pitch from melting.

In one embodiment, multiple cutting tips are used to create grooves of different sizes into lapping surface 108. A small cutting tip is first used to cut small grooves (e.g., 0.06" wide and 0.03" deep) into lapping surface 108, and a large cutting tip is then used to cut larger grooves (e.g., 0.5" wide and 0.3" deep). When using a large cutting tip, it may be desirable to use a more powerful motor for cutting tool 216 to provide sufficient torque for rotating cutting bit 302. The small grooves allow the slurry to flow, which prevents the workpiece being polished from hydroplaning over lapping surface 108. The large grooves also allow the slurry to flow, but in addition provide clearance so that the pitch forming lapping surface 108 can flow during use. In one embodiment, cutting tool 216 is removable from cutting tool carriage 226 to allow for quick replacement of cutting tool 216, such as when switching from the small groove to the large groove patterning process.

The triangular patterning apparatus 102 shown in FIG. 2 can be used to pattern a 45° portion of lapping surface 108. After this 45° portion is completely patterned, lapping table 110 is rotated 45° to expose another 45° portion of unpatterned lapping surface 108. The patterning process described above is repeated until the entire lapping surface 108 is patterned.

The speed of movement of cutting tool 216, the rotational velocity of the cutting bit, and the groove depth and size are variable in different embodiments, depending on the type of pitch used and the desired lapping surface pattern. Good results in producing small grooves have been obtained using an "L"-shaped carbide burr having a ⅛" diameter, set at a 0.040" maximum cutting depth, rotating at 65,000 RPM, and moving along the desired lapping surface pattern at a speed of 200 inches per minute. Large grooves have been produced using an "C"-shaped carbide burr having a ¼" shank, ½" diameter, set at a 0.050"–0.100" cutting depth, rotating at 40,000 RPM, and moving along the desired pattern at a speed of 50 inches per minute.

Embodiments of the present invention provide numerous advantages. First, the precise positioning provided by patterning apparatus 102, the accuracy of the pneumatically-driven carbide cutting tip 302, and computer-automated control system 104 together enable patterns to be repeatedly formed on a lapping surface with consistency. The use of a programmable control system 104 enables any groove pattern to be generated. In addition, the motor-driven cutting tip 302 provides faster patterning than traditional manual processes. The system is ergonomically sound because it does not require a human operator to perform repetitive motions in an unsafe workzone. The use of a DI water rinse captures pitch particles, thereby reducing particle release into the air, and simultaneously cools the pitch, which prevents melting and provides a sharper, cleaner edge to the grooves in the pattern.

The design of embodiments of patterning apparatus 102 provides numerous workspace advantages as well. As described above with respect to FIGS. 1 and 2, patterning apparatus 102 may be removable and can be brought easily to the location of CP tool 106, as needed. This portability enables a single pattering system 100 to be used to pattern a large number and variety of CP tools in distant locations at a manufacturing facility.

Various alternative embodiments of the present invention are possible, as would be understood by one of ordinary skill in the art. In the embodiment described above, patterning system 102 has an angular span of 45°. The wedge-shaped profile of patterning system 102 enables system 102 to be used even when there are numerous other mechanical components which overhang lapping surface 108 or otherwise limit the available space above and around lapping surface 108. Depending on the space restrictions for the particular application, other embodiments of the present invention may have angular spans of greater than or less than the 45° span shown.

Although the invention has been described with reference to particular embodiments, the description is only an example of the invention's application and should not be taken as a limitation. In particular, even though much of preceding discussion was aimed at pitch-coated lapping surfaces, alternative embodiments of this invention can be used to pattern various other polishing surfaces. Various other adaptations and combinations of features of the embodiments disclosed are within the scope of the invention as defined by the following claims.

I claim:

1. A system for patterning a lapping surface on a lapping tool, said lapping surface having a circular inner diameter and a circular outer diameter, said system comprising:

an outer support mounted on the lapping tool;

a radial arm having an inner end rotatably supported at an axis of rotation located within the inner diameter of the lapping surface and an outer end movably supported by said outer support such that said radial arm is rotatable about the axis of rotation;

a cutting tool mounted on the radial arm for movement from the inner diameter of the lapping surface to the outer diameter of the lapping surface;

a radial positioning motor for positioning the cutting tool at a plurality of locations between the inner diameter of the lapping surface and the outer diameter of the lapping surface; and an angular positioning motor for rotating the radial arm about the axis of rotation to position the radial arm at a plurality of angular locations.

2. The system of claim 1, further comprising:

a motion controller, comprising:

a position memory for storing radial position information and angular position information; and a motor interface connecting the position memory with the radial positioning motor and the angular positioning motor to transmit the radial position information to the radial positioning motor and the angular position information to the angular positioning motor.

3. The system of claim 2, wherein said motion controller further comprises:

an external data interface for receiving pattern information;

a pattern memory connected to the external data interface for storing the pattern information; and a processing facility connected to the pattern memory for converting pattern information into the radial position information and the angular position information and storing the radial position information and the angular position information in the position memory.

4. The system of claim 1, wherein:

said outer support includes a radial arm carriage mounted for movement along the outer support;

said outer end of said radial arm is mounted on said carriage;

said radial arm includes a cutting tool carriage mounted for movement along the radial arm; and said cutting tool is mounted onto the cutting tool carriage.

5. The system of claim 1, wherein:

said inner end of said radial arm includes a first radial arm section and said outer end of said radial arm comprises a second radial arm section, said first radial arm section being movably attached to said second radial arm section such that a length of said radial arm is adjustable.

6. The system of claim 1, further comprising:

a rinse fluid source; and a rinse fluid nozzle in fluid communication with the rinse fluid source, said rinse fluid nozzle providing rinse fluid to a location of a cutting tip of the cutting tool.

7. A system for patterning a lapping surface on a lapping tool, said lapping surface having a circular inner diameter and a circular outer diameter, said system comprising:

a patterning apparatus, comprising:

an outer support mounted on the lapping tool;

a radial arm having an inner end rotatably supported at an axis of rotation located within the inner diameter of the lapping surface and an outer end movably supported by said outer support such that said radial arm is rotatable about the axis of rotation;

an angular positioning motor for rotating the radial arm about the axis of rotation to position the radial arm at a plurality of angular locations;

a cutting tool mounted on the radial arm for movement from the inner diameter of the lapping surface to the outer diameter of the lapping surface; and a radial positioning motor for positioning the cutting tool at a plurality of locations between the inner diameter of the lapping surface and the outer diameter of the lapping surface; and a motion controller, comprising:

a position memory for storing radial position information and angular position information; and a motor interface connecting the position memory with the radial positioning motor and the angular positioning motor to transmit the radial position information to the radial positioning motor and the angular position information to the angular positioning motor.

8. The system of claim 7, further comprising:

a cart for holding the patterning apparatus when not in use, the motion controller being mounted on said cart.

9. The system of claim 7, wherein said motion controller further comprises:

an external data interface for receiving pattern information;

a pattern memory connected to the external data interface for storing the pattern information; and a processing facility connected to the pattern memory for converting pattern information in the pattern memory into the radial position information and the angular position information and storing the radial position information and the angular position information in the position memory.

10. The system of claim 7, further comprising:

a rinse fluid source; and a rinse fluid nozzle in fluid communication with the rinse fluid source, said rinse fluid nozzle providing rinse fluid to a location of a cutting tip of the cutting tool.

11. The system of claim 7, wherein:

said outer support comprises a radial arm carriage mounted for movement along the outer support;

said outer end of said radial arm is mounted on said carriage;

said radial arm comprises a cutting tool carriage mounted for movement along the radial arm; and said cutting tool is mounted onto the cutting tool carriage.

12. The system of claim 7, wherein:

said inner end of said radial arm comprises a first radial arm section and said outer end of said radial arm comprises a second radial arm section, said first radial arm section being movably attached to said second radial arm section such that a length of said radial arm is adjustable.

13. A method for patterning a lapping surface on a lapping tool, said lapping surface having a circular inner diameter and a circular outer diameter, said method comprising:

positioning a patterning apparatus over the lapping surface, said patterning apparatus comprising an outer support mounted on the lapping tool, a radial arm having an inner end rotatably supported at an axis of rotation located within the inner diameter of the lapping surface and an outer end movably supported by said outer support, and a cutting tool mounted on the radial arm for movement from the inner diameter of the lapping surface to the outer diameter of the lapping surface;

storing pattern information in a motion controller memory;

transmitting control information to a radial positioning motor for positioning the cutting tool along the radial arm and to an angular positioning motor for rotating the radial arm about the axis of rotation, said control information corresponding to said pattern information in the motion controller memory; and operating said cutting tool to form grooves in the lapping surface corresponding to the pattern information.

14. The method of claim 13, wherein said step of storing pattern information in the motion controller memory comprises:

receiving Cartesian pattern information corresponding to a Cartesian coordinate system; and converting the Cartesian pattern information into polar pattern information corresponding to a polar coordinate system; and storing said polar pattern information in the motion controller memory.

15. The method of claim 13, further comprising:

discharging a rinse fluid to a location of said cutting tool while operating said cutting tool to form grooves in the lapping surface.

* * * * *